US008544458B1

(12) United States Patent
LoRocco et al.

(10) Patent No.: US 8,544,458 B1
(45) Date of Patent: Oct. 1, 2013

(54) ARROW REST ASSEMBLY WITH CANTILEVERED SUPPORT ARMS

(71) Applicant: TruGlo, Inc., Richardson, TX (US)

(72) Inventors: Paul LoRocco, Dallas, TX (US); John Estridge, Plano, TX (US)

(73) Assignee: TruGlo, Inc., Richardson, TX (US)

( * ) Notice: Subject to any disclaimer, the term of this patent is extended or adjusted under 35 U.S.C. 154(b) by 0 days.

(21) Appl. No.: 13/833,232

(22) Filed: Mar. 15, 2013

(51) Int. Cl.
*F41B 5/22* (2006.01)

(52) U.S. Cl.
USPC ..... 124/44.5

(58) Field of Classification Search
USPC ..... 124/24.1, 44.5
See application file for complete search history.

(56) References Cited

U.S. PATENT DOCUMENTS

| | | | | | |
|---|---|---|---|---|---|
| 4,351,311 | A * | 9/1982 | Phares | ..... | 124/44.5 |
| 4,473,058 | A | 9/1984 | Terry | | |
| 4,608,959 | A | 9/1986 | Seynaeve | | |
| 5,025,773 | A * | 6/1991 | Hintze et al. | ..... | 124/44.5 |
| 5,042,450 | A * | 8/1991 | Jacobson | ..... | 124/44.5 |
| 5,253,633 | A * | 10/1993 | Sisko | ..... | 124/44.5 |
| 5,526,800 | A * | 6/1996 | Christian | ..... | 124/44.5 |
| 5,632,263 | A | 5/1997 | Sartain | | |
| 5,685,287 | A | 11/1997 | Greywall | | |
| 6,089,216 | A | 7/2000 | Harwath et al. | | |
| 6,557,541 | B2 * | 5/2003 | Pinto, Jr. | ..... | 124/44.5 |
| 6,688,296 | B1 | 2/2004 | Greywall | | |

* cited by examiner

*Primary Examiner* — John Ricci
(74) *Attorney, Agent, or Firm* — Alvin R. Wirthlin

(57) ABSTRACT

An arrow rest for supporting the shaft of an arrow includes a ring-shaped support body with first and second side wall portions and a gap therebetween to receive and capture the arrow shaft. Resilient support arms are cantilevered from the side wall portions. The resilient support arms support the arrow shaft and flex in response to arrow launch. Corrugated dampening members are located between the support arms and a floor of the support body.

17 Claims, 4 Drawing Sheets

ARROW REST ASSEMBLY WITH CANTILEVERED SUPPORT ARMS

BACKGROUND OF THE INVENTION

This invention relates generally to accessories for archery bows, and more particularly to an arrow rest that deflects during release of an arrow from an archery bow.

In hunting, 3D archery, and field archery, accuracy is of paramount importance. The presence of the arrow rest plays a very significant role in achieving accuracy in shooting. There are at least four factors in the operation of a compound bow which may be affected by the presence of the arrow rest. First, the trajectory of the arrow can be altered when the fletching of the arrow contacts the rest. Second, because all arrows are sized to bend slightly under the instantaneous load applied to the shaft upon release, the trajectory of the arrow can be altered by its deflection against the rest, especially if the rest is rigid. Third, during release of the arrow, the archer may subject the bow to some inadvertent horizontal or vertical movement that is transferred to the rest and thence to the arrow, thereby causing the trajectory of the arrow to be altered. Fourth, noise generated as the arrow shaft slides across the arrow rest can be sufficient to create undesirable friction and frighten game during hunting.

It would therefore be desirous to provide an arrow rest that overcomes one or more of the above-mentioned factors.

BRIEF SUMMARY OF THE INVENTION

According to one aspect of the invention, an arrow rest for supporting the shaft of an arrow includes a support body having first and second side wall portions and a gap therebetween to receive and capture the arrow shaft. A first resilient support arm is cantilevered from one of the side wall portions. The resilient support arm is adapted to support the arrow shaft and flex in response to launch of the arrow.

According to a further aspect of the invention, an arrow rest assembly for supporting the shaft of an arrow includes a mounting bracket adapted for connection to the riser of a bow, an adjustment block connected to the mounting bracket, the adjustment block being adjustable in elevation with respect to the mounting bracket, a connector arm connected to the adjustment block, the connector arm being adjustable in a windage direction with respect to the adjustment block, and a support body connected to the connector arm. The support body is generally ring-shaped and includes first and second side wall portions, a floor portion extending between a lower end of the side wall portions, and a gap located at an upper end therebetween to receive and capture the arrow shaft. First and second resilient support arms are cantilevered from the first and second side wall portions, respectively, for supporting the arrow shaft and flexing in response to applied forces during arrow launch. First and second dampening members are located between the first and second resilient support arms, respectively, and the floor portion to resist flexing of the first and second resilient support arms.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
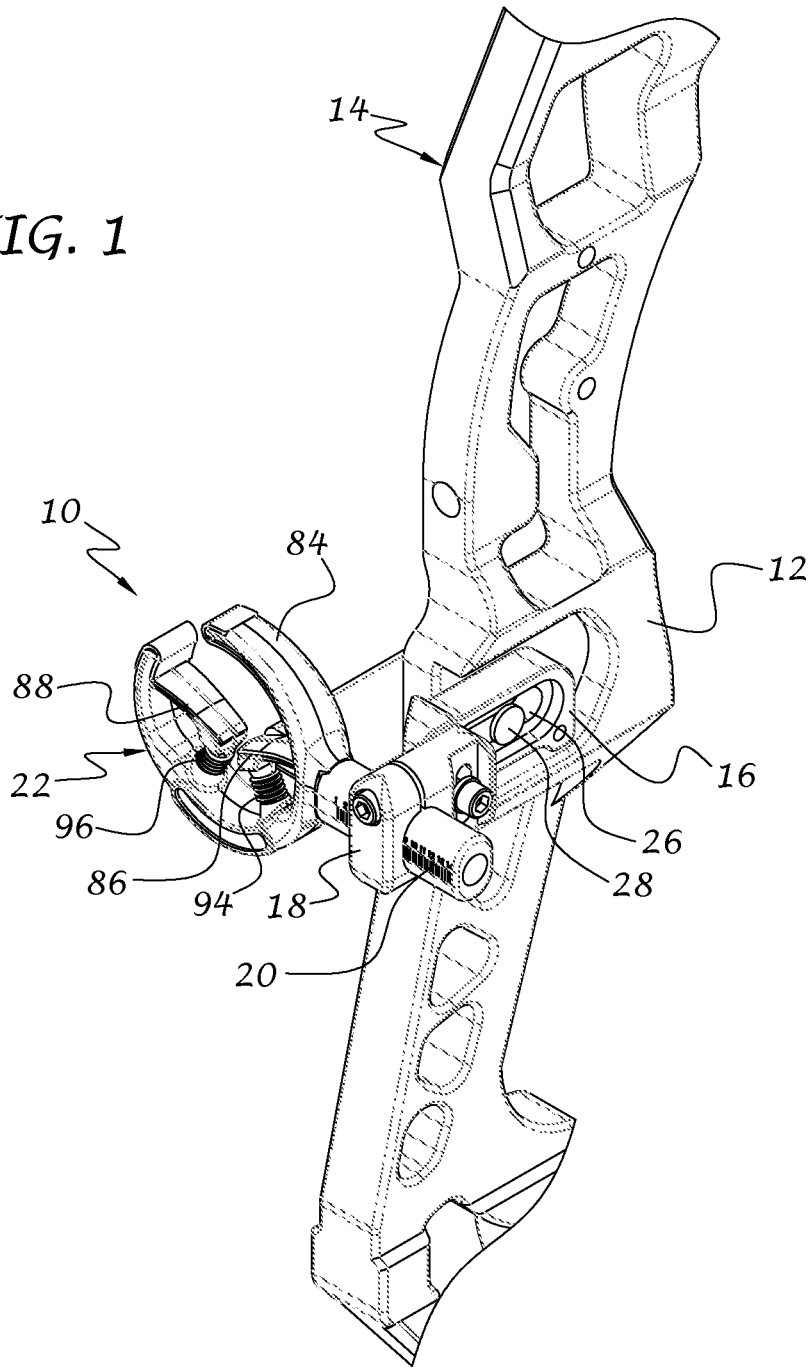
FIG. 1 is a rear isometric view of a resilient arrow rest assembly in accordance with the present invention connected to the riser of an archery bow.

Referring now to FIG. 1 of the drawings, a resilient arrow rest assembly 10 in accordance with the present invention is shown connected to the riser 12 of a compound archery bow 14 (only partially shown). The compound archery bow 14 is for illustration purposes only since the arrow rest assembly 10 of the present invention can be adapted for use with any type of bow including, but not limited to, crossbows, recurve bows, reflex bows, longbows, and so on.

Figure 2:
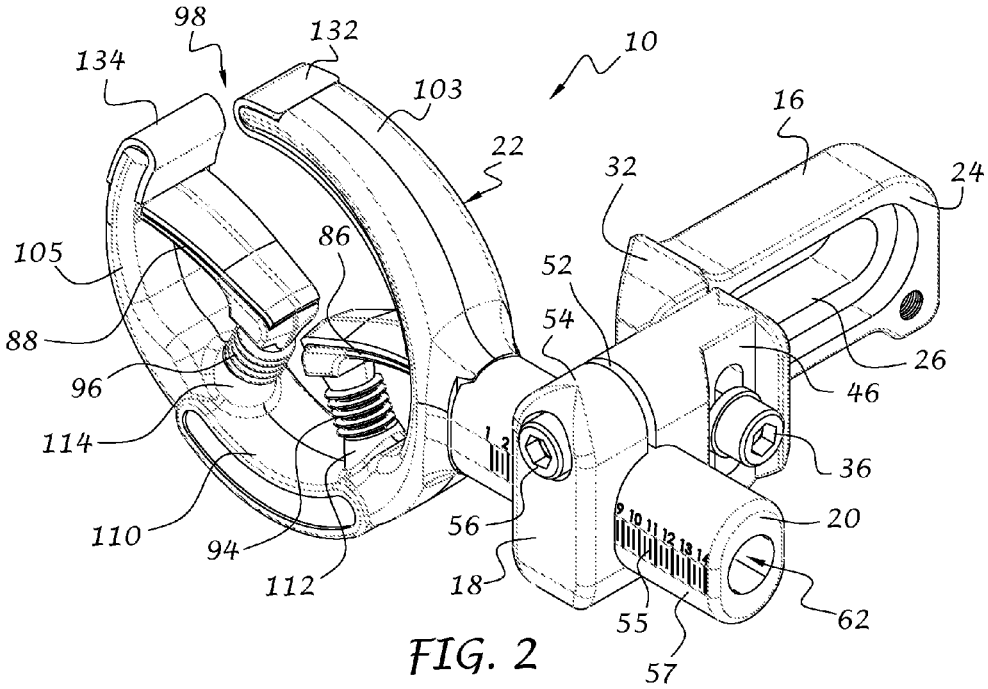
FIG. 2 is a rear isometric view of the resilient arrow rest assembly.
Figure 3:
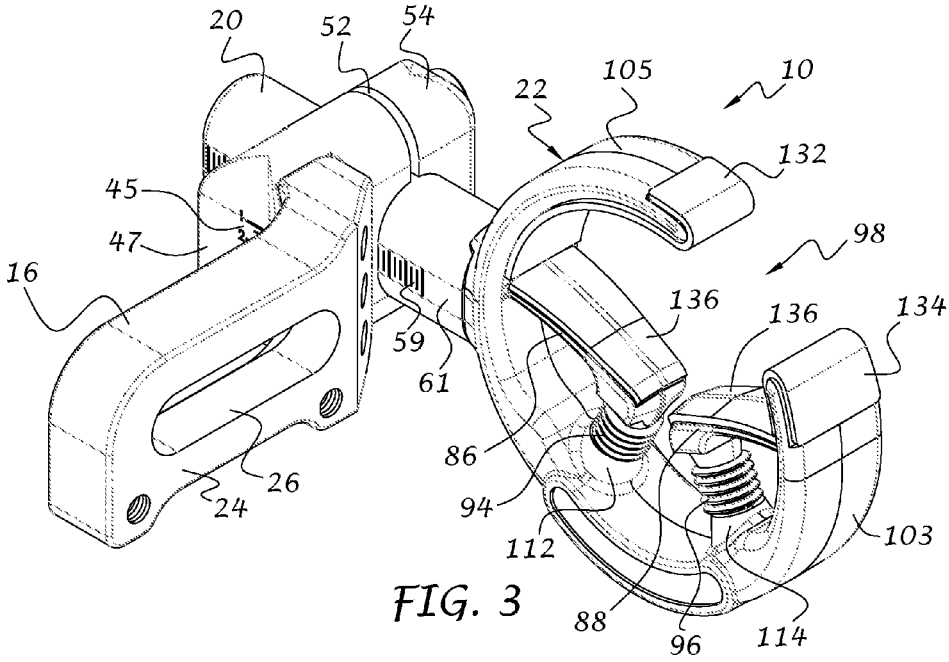
FIG. 3 is a front isometric view thereof.

With additional reference to FIGS. 2 and 3, the resilient arrow rest assembly 10 preferably includes a mounting bracket 16 for connection to the riser 12 (FIG. 1) of a bow or the like, an adjustment block 18 connected to the mounting bracket 16, a connector arm 20 connected to the adjustment block 18, and an arrow rest 22 connected to the connector arm 20.

Figure 4:
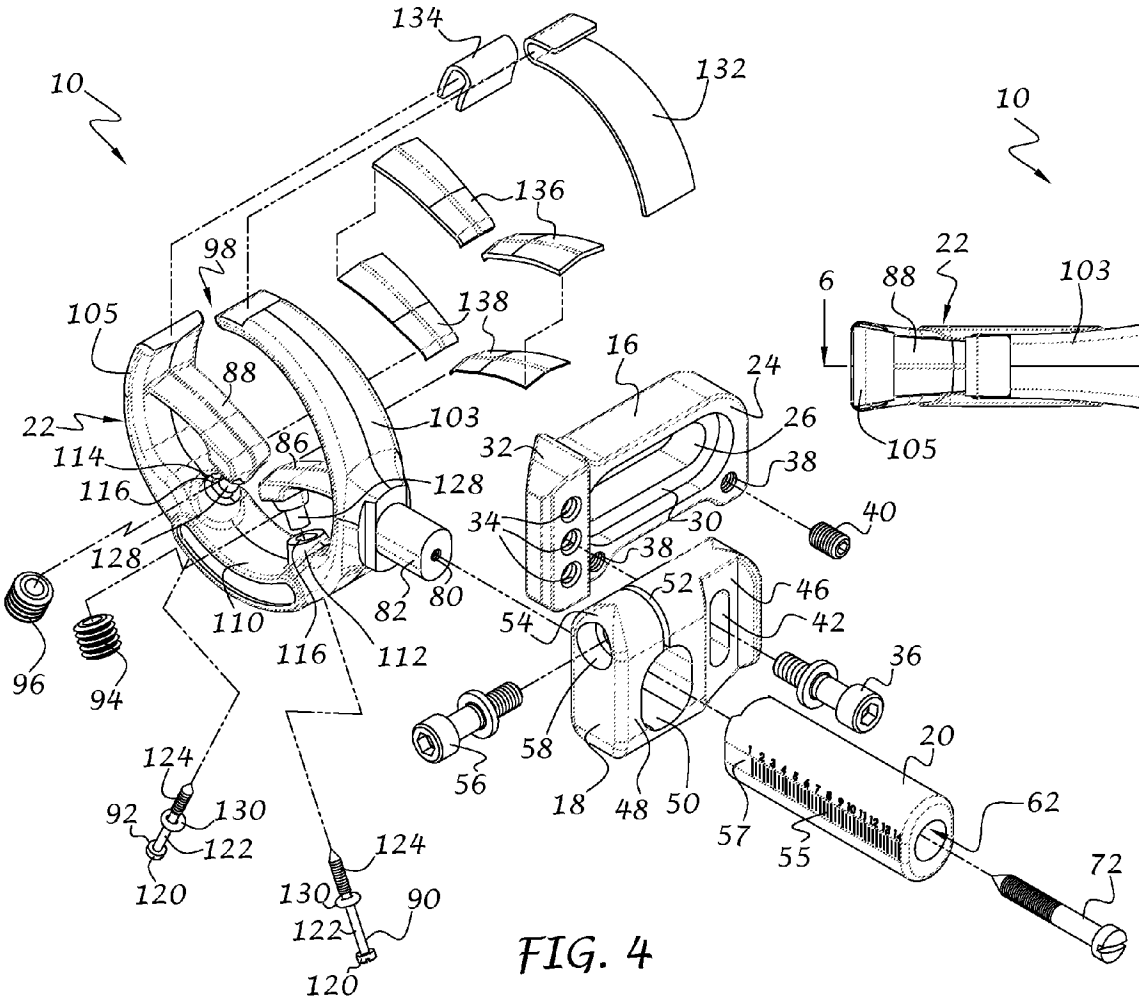
FIG. 4 is a rear isometric exploded view thereof.

With further reference to FIG. 4, the mounting bracket 16 can be of conventional construction and preferably includes an elongate base plate 24 that, when mounted to a bow or the like, extends in a generally horizontal direction. The base plate 24 preferably includes an elongate slot 26 extending therethrough for receiving a fastener 28 (FIG. 1) or the like so that the mounting bracket 16 can be attached to the riser 12 of a bow 14 in a well-known manner. An elongate recess 30 is formed adjacent to and surrounds the groove so that the fastener head can be located within the mounting bracket 16. A connecting portion 32 of the mounting bracket 16 is located rearwardly of the elongate base plate 24 and extends in a transverse direction thereto, or in a generally vertical direction when the mounting bracket 16 is mounted to the bow or the like. Threaded openings 34 are formed in the connecting portion 32 for receiving a threaded fastener 36 or the like when connecting the adjustment block 18 thereto. Threaded openings 38 are also formed in the base plate 24 for receiving a set screw 40 (only one shown). Since the risers of most bows are provided with only a single mounting opening for connecting an arrow rest thereto, one or more of the set screws can be used to press against the riser 12 (FIG. 1) of a bow when the resilient arrow rest assembly 10 is connected thereto so that the arrow rest assembly does not rotate or otherwise move with respect to the riser.

The adjustment block 18 preferably includes an elongate slot 42 that extends in a generally vertical direction and is in alignment with the threaded openings 38. The elongate slot 42 is adapted to receive the threaded fastener 36 so that the adjustment block 18 can be connected to the mounting bracket 16. The combination of the elongate slot 42 and plurality of threaded openings 34 in the connecting portion 32 ensures that a wide range of elevation adjustment is available to the user, while maintaining relatively low profiles of the mounting bracket 16 and adjustment block 18, thereby reducing the size and material requirements. As partially shown in FIG. 3, a scale 45 can be located on a forward face 47 to assist with the elevation adjustment.

Figure 5:
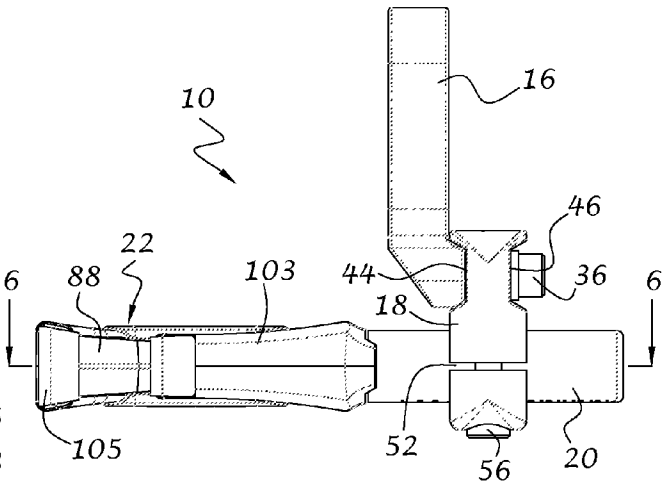
FIG. 5 is a top plan view thereof.

As best shown in FIG. 5, the adjustment block 18 preferably includes a left side groove 44 and an opposing right side groove 46 that are similar in shape and coincident with the elongate slot 42 (FIG. 4). The grooves 44 and 46 are also complimentary in shape to the connecting portion 32. In the right-handed set-up as shown, the connecting portion 32 is received in the left side groove 44 so that the arrow rest 22 is positioned on the left side of the riser 12 (FIG. 1). In a left-handed set-up (not shown), the connecting portion 32 is received in the right side groove 46 so that the arrow rest 22 is positioned on the right side of the riser 12 (FIG. 1). In this manner, the arrow rest assembly 10 is quickly and easily converted between right-hand and left-hand use, depending on the preferences of the individual user.

Referring to FIGS. 2-5, the adjustment block 18 also includes a clamping portion 48 for holding the connector arm 20 in an adjusted windage position. The clamping portion 48 preferably includes an opening 50 for receiving the connector arm 20, a slot 52 that extends from an upper edge 54 of the adjustment block to the opening 50, and a threaded fastener 56 that extends through a first transverse opening 58 in the adjustment block on one side of the slot 52, and a second transverse opening 60 (FIG. 6) on the opposite side of the slot 52. The second transverse opening 60 is preferably threaded to accommodate the threaded portion of the fastener 56. In order to clamp the connector arm to the adjustment block 18, the connector arm 20 is inserted into the opening 50 and adjusted until the desired windage position is attained. The fastener 56 is then tightened to thereby close the slot 52, and thus reduce the size of the opening 50, until the connector arm 20 is firmly held in the clamping portion 48. When it is desirous to adjust or remove the connector arm with respect to the adjustment block 18, the fastener 56 is loosened until the connector arm 20 can slide out of the opening 50. As best shown in FIGS. 2 and 3, a first windage scale 55 is preferably located on a rear face 57 of the connector arm 20 and a second windage scale 59 is preferably located on a front face 61 of the connector arm to facilitate windage adjustment. The provision of opposing scales on the connector arm 20 ensures that one of the scales will be viewed in both the right-handed and left-handed configurations.

Figure 6:
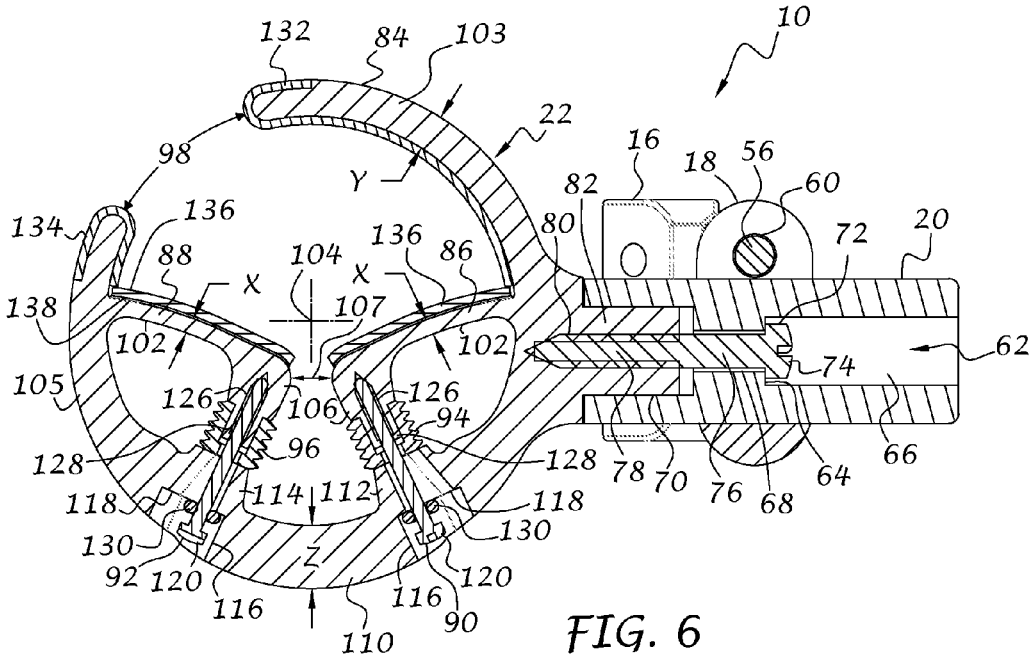
FIG. 6 is a sectional view of the resilient arrow rest assembly taken along line 6-6 of FIG. 5.

With additional reference to FIG. 6, the connector arm 20 is preferably complementary in shape to the opening 50 and includes a central bore 62 with an inner annular step 64 that divides the bore 62 into a first bore segment 66, a second reduced diameter bore segment 68, and a third enlarged diameter bore segment 70. A threaded fastener 72 preferably extends through the first, second and third bore segments with a head portion 74 of the fastener located in the first bore segment 66, a shank portion 76 located in the second bore segment 68, and a threaded shaft portion 78 located in the third bore segment 70. When the arrow rest 22 is connected to the connector arm 20, the head 74 of the fastener 72 abuts the annular step 64 and the threaded shaft portion 78 extends into a threaded aperture 80 of an extension member 82 associated with the arrow rest 22. The extension member 82 is also positioned within the third bore segment 70 to thereby secure the arrow rest 22 to the connector arm 20 and thus the mounting bracket 16.

When it is desirous to change from a right-handed setup to a left-handed setup, the connector arm 20 can be removed from the opening 50 by moving the arrow rest 22 to the left, as shown in FIG. 6, then re-inserting the connector arm 20 into the opening 50 on the opposite side of the adjustment block 18. Due to the asymmetric nature of the arrow rest 22 along the section line 6-6 of FIG. 5, it is not necessary to remove the arrow rest 22 from the connector arm 20 during the change, thus decreasing the number of steps and time to change the arrow rest assembly 10 between right-handed and left-handed setups.

The arrow rest 22 preferably includes a support body 84, resilient support arms 86 and 88 extending inwardly from the support body, guide members 90 and 92 and dampening members 94 and 96 associated with the support arms 86 and 88, respectively. The support body 84 and the and resilient support arms 86, 88 are preferably constructed of a single piece of material, such as reinforced plastic, metal, or the like. The support body 84 is preferably generally ring-shaped with a central axis 104 (FIG. 6) and includes a gap 98 configured to receive and capture the shaft 100 (FIG. 7) of an arrow, bolt, or the like. Each support arm has a relatively thin profile, denoted by thickness X, as shown in FIG. 6, when compared to the support body 84, as denoted by thickness Y or thickness Z, so that the support arms can deflect when subjected to downward forces and spring back to their original position once the forces have been removed, such forces occurring for example during arrow launch.

The support arms 86, 88 preferably include a first cantilevered arm segment 102 located on opposite sides of the support body 84 above a central axis 104 of the annular support body 84 and a second arm segment 106 that extends generally downwardly and outwardly from the first arm segment 102. A gap 107 is formed between the support arms 86, 88 to provide clearance for the cock feather (not shown) of an arrow. In this manner, the cock feather is oriented downwardly. In the event that the cock feather is not properly oriented, the support arms 86, 88 are sufficiently durable to resist impact forces from the arrow vanes. The first arm segment 102 preferably curves downwardly and inwardly from opposite side wall portions 103, 105 of the support body 84 so that the second arm segments are positioned lower than the central axis 104. In this manner, an arrow shaft 100 can be placed on the support arm with a shaft axis 108 (FIG. 7) that is proximal to or coincident with the central axis 104 so that the arrow shaft 100 is approximately centrally located in the annular support body 84.

Accordingly, the size of the annular support body 84 can be kept to a minimum while providing sufficient clearance for the arrow fletching (not shown).

A floor portion 110 of the support body 84 preferably includes spaced bosses 112 and 114. A bore 116 extends through each boss 112 and 114 for receiving the guide members 90 and 92, respectively. Each boss preferably includes an inner step 118 that forms a reduced diameter portion through which the guide members extend. Each guide member 90, 92 preferably includes a head portion 120, a shank portion 122, and a threaded shaft portion 124 that extends into a threaded aperture 126 formed in the second arm segment 106. When installed, the head portion 120 is located in the bore 116 and spaced from the inner step 118, with the threaded shaft portion 124 received in the aperture 126. The shank portion 122 extends through a reduced diameter section of the bore 116, as defined by the inner step 118, and guides movement of the second arm segment 106 during flexing movement. An O-ring 130 is preferably positioned around the shank portion 122 and serves as a shock absorber between the had portion 120 and the inner step 118 when the resilient support arms 86, 88 spring back from a flexed state during arrow launch.

The dampening members 94, 96 are preferably positioned between their respective bosses 112, 114 and second arm segments 106. Each second arm segment preferably has a cylindrically-shaped projection 128 that extends into the dampening member 94 or 96 so that the dampening members are sandwiched between their respective bosses and second arm segments. The guide members also preferably extend through the dampening members to thereby secure the dampening members to the support body 84. The dampening members are preferably of cylindrical construction and corrugated to allow their flexure during movement of the resilient support arms. The dampening members 94, 96 are preferably constructed of silicon rubber with a Shore A hardness of approximately 30. However, it will be understood that the invention is not limited to the particular material or hardness described, but can include different materials and/or harnesses without departing from the spirit and scope of the invention.

Figure 7:
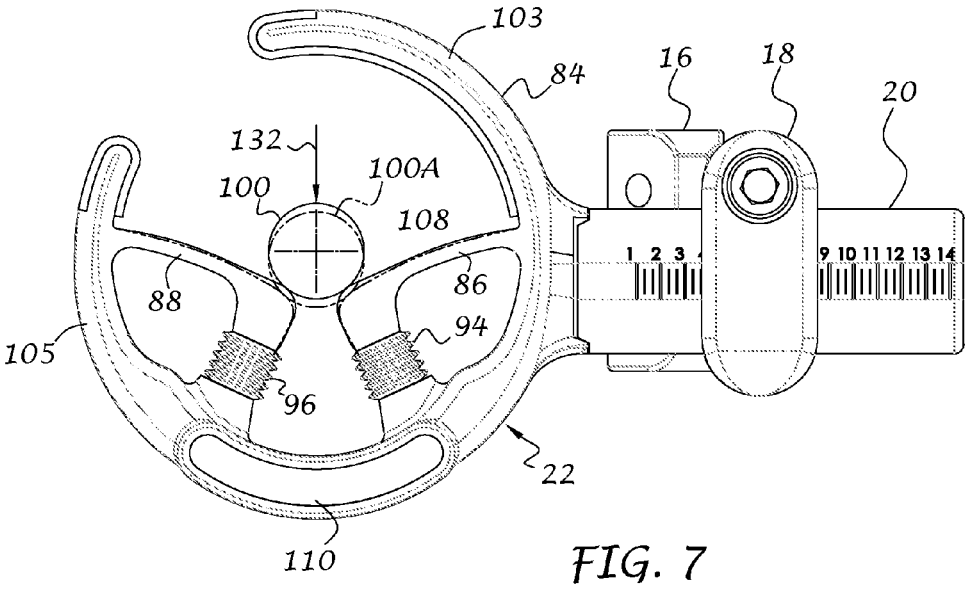
FIG. 7 is a rear elevational view of the resilient arrow rest assembly showing movement of the support arms during arrow release.

In use, and with further reference to FIG. 7, during launch of an arrow, the high forces immediately after releasing a bowstring causes sudden and temporary flexure or bending of the arrow shaft, as demonstrated by the arrow shaft 100A in phantom line, as it passes along the resilient support arms 86 and 88, which in turn creates a downward force on the support arms, as represented by arrow 132 in FIG. 7, thereby causing the support arms to deflect. In this manner, the temporary bending of the arrow shaft is accommodated. The configuration of the support arms, including their curvilinear path, thickness and overall shape, provide the proper balance between resilience and stiffness so that the support arms do not interfere with the forward direction of the arrow during arrow launch. As the support arms deflect, the dampening members 94, 96 reduce vibration and its resultant noise that may occur in the support arms. When the downward force is removed, the support arms 86 and 88 spring back to their rest position. The head portions 120 together with the inner step 118 and O-ring 130, ensure that the support arms do not over-extend during the return movement and quickly return to their rest position.

In order to further reduce noise and vibration during arrow launch, and as best shown in FIGS. 4 and 6, noise-reducing material, such as layers 132 and 134, can be attached to the side portions 103, 105 of the support body 84. Likewise, noise and/or friction-reducing material, such as layers 136 and 138, can be applied to the resilient support arms 86 and 88. The material can include, but is not limited to, bearing tape or other materials with a low coefficient of friction, felt or other non-woven materials, ceramic coatings, metallic or plastic bearing material, as so on.

Although two resilient support arms have been shown and described, it will be understood that one support arm or more than two support arms can be used without departing from the spirit and scope of the invention. Moreover, each support arm can have a different resilience or flexibility to accommodate the needs of an individual user and the user's particular shooting configuration. The resilience can be adjusted by providing different dampening members, different support arm thicknesses and/or shapes, and by adjusting the material properties of at least the support arms.

In addition, although the support arms are shown as integrally formed or molded with the support body, it is contemplated that the support arms can be formed separately and installed on the side portions of the support body. In this manner, the removable support arms can be replaced with other support arms having a different size, shape, flexibility, and so on.

It will be understood that the term "preferably" as used throughout the specification refers to one or more exemplary embodiments of the invention and therefore is not to be interpreted in any limiting sense. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. It will be understood, therefore, that the present invention is not limited to the particular embodiments disclosed, but also covers modifications within the spirit and scope of the invention as defined by the appended claims.

What is claimed is:

1. An arrow rest for supporting the shaft of an arrow, comprising:

a support body having first and second side wall portions and a gap therebetween to receive and capture the arrow shaft;

a first resilient support arm cantilevered from one of the side wall portions, the resilient support arm being adapted to support the arrow shaft and flex in response to launch of the arrow;

a second resilient support arm cantilevered from the other of the side wall portions, the first and second resilient support arms being adapted to support the arrow shaft and flex in response to arrow launch;

a floor portion located between the first and second side wall portions; and first and second damping members positioned between a free end of the first and second resilient support arms, respectively, and the floor portion.

2. An arrow rest according to claim 1, and further comprising first and second guide members extending through the floor portion, the first and second damping members, and are connected to the first and second resilient support arms, respectively.

3. An arrow rest according to claim 2, wherein the guide members are movable when the first and second resilient support arms are flexed.

4. An arrow rest according to claim 3, wherein each resilient support arm comprises a first cantilevered arm segment that extends inwardly from its respective side wall portion.

5. An arrow rest according to claim 4, wherein the support body is generally ring-shaped to define a central axis, and further wherein the first cantilevered arm segment is connected to its respective side wall portion at a position above the central axis.

6. An arrow rest according to claim 5, wherein the first cantilevered arm segment curves inwardly and downwardly, a free end thereof terminating at a position below the central axis.

7. An arrow rest according to claim 6, wherein each resilient support arm further comprises a second arm segment that extends generally downwardly from the first cantilevered arm segment.

8. An arrow rest according to claim 7, wherein the guide members extend into their respective second arm segments.

9. An arrow rest for supporting the shaft of an arrow, comprising:

a support body having first and second side wall portions and a gap therebetween to receive and capture the arrow shaft and a floor portion located between the first and second side wall portions;

a first resilient support arm cantilevered from one of the side wall portions, the resilient support arm being adapted to support the arrow shaft and flex in response to launch of the arrow; and a first damping member positioned between a free end of the first resilient support arm and the floor portion.

10. An arrow rest according to claim 9, and further comprising a first guide member extending through the floor portion, the first damping member, and is connected to the first resilient support arm.

11. An arrow rest according to claim 10, wherein the guide member is movable when the first resilient support arm is flexed.

12. An arrow rest according to claim 11, wherein the first resilient support arm comprises a first cantilevered arm segment that extends inwardly from the first side wall portion.

13. An arrow rest according to claim 12, wherein the support body is generally ring-shaped to define a central axis, and further wherein the first cantilevered arm segment is connected to the first side wall portion at a position above the central axis.

14. An arrow rest according to claim 13, wherein the first cantilevered arm segment curves inwardly and downwardly, a free end thereof terminating at a position below the central axis.

15. An arrow rest according to claim 14, wherein the first resilient support arm further comprises a second arm segment that extends generally downwardly from the first cantilevered arm segment.

16. An arrow rest according to claim 15, wherein the first guide member extends into the second arm segment.

17. An arrow rest assembly for supporting the shaft of an arrow, comprising:

a mounting bracket adapted for connection to the riser of a bow;

an adjustment block connected to the mounting bracket, the adjustment block being adjustable in elevation with respect to the mounting bracket;

a connector arm connected to the adjustment block, the connector arm being adjustable in a windage direction with respect to the adjustment block;

a support body connected to the connector arm, the support body being generally ring-shaped and including first and second side wall portions, a floor portion extending between a lower end of the side wall portions, and a gap located at an upper end therebetween to receive and capture the arrow shaft;

first and second resilient support arms cantilevered from the first and second side wall portions, respectively, for supporting the arrow shaft and flexing in response to applied forces during arrow launch;

first and second dampening members located between the first and second resilient support arms, respectively, and the floor portion to resist flexing of the first and second resilient support arms.

* * * * *